US008696979B2

(12) United States Patent
Yokokawa et al.

(10) Patent No.: US 8,696,979 B2
(45) **Date of Patent: *Apr. 15, 2014**

(54) NI-BASE SUPERALLOY AND METHOD FOR PRODUCING THE SAME

(75) Inventors: Tadaharu Yokokawa, Tsukuba (JP); Yutaka Koizumi, Tsukaba (JP); Hiroshi Harada, Tsukuba (JP); Toshiharu Kobayashi, Tsukuba (JP)

(73) Assignee: National Institute for Materials Science, Ibaraki (JP)

( * ) Notice: Subject to any disclaimer, the term of this patent is extended or adjusted under 35 U.S.C. 154(b) by 922 days.

This patent is subject to a terminal disclaimer.

(21) Appl. No.: 12/225,710

(22) PCT Filed: Mar. 16, 2007

(86) PCT No.: PCT/JP2007/055451

§ 371 (c)(1),
(2), (4) Date: May 11, 2009

(87) PCT Pub. No.: WO2007/122931

PCT Pub. Date: Nov. 1, 2007

(65) Prior Publication Data

US 2009/0317288 A1 Dec. 24, 2009

(30) Foreign Application Priority Data

Mar. 31, 2006 (JP) ..... 2006-096594

(51) Int. Cl.
*C22C 19/05* (2006.01)
*C22F 1/10* (2006.01)

(52) U.S. Cl.
USPC ..... 420/444; 420/448; 148/555

(58) Field of Classification Search
USPC ..... 420/444, 448; 148/555
See application file for complete search history.

(56) References Cited

U.S. PATENT DOCUMENTS

| | | | | |
|---|---|---|---|---|
| 4,643,782 | A | 2/1987 | Harris et al. | |
| 5,489,194 | A * | 2/1996 | Yoshinari et al. | 416/241 R |
| 6,929,868 | B2 | 8/2005 | Kelly et al. | |
| 2005/0092398 | A1 * | 5/2005 | Kobayashi et al. | 148/404 |
| 2005/0260346 | A1 * | 11/2005 | Heng et al. | 427/248.1 |

FOREIGN PATENT DOCUMENTS

| | | |
|---|---|---|
| JP | 2002-302724 | 10/2002 |
| JP | 2005-097649 | 4/2005 |

OTHER PUBLICATIONS

English Abstract and English Machine Translation of Harada et al. (Jp 2005-097649) (2005).*

* cited by examiner

*Primary Examiner* — Jessee Roe
(74) *Attorney, Agent, or Firm* — Wenderoth, Lind & Ponack, L.L.P.

(57) ABSTRACT

A Ni-base superalloy having a chemical composition comprising Al: 4.5-7.0 wt %, Ta+Nb+Ti: 0.1-4.0 wt %, with Ta being less than 4.0 wt %, Mo: 1.0-8.0 wt %, W: 0.0-10.0 wt %, Re: 2.0-8.0 wt %, Hf: 0.0-1.0 wt %, Cr: 2.0-10.0 wt %, Co: 0.0-15.0 wt %, Ru: 0.0-5.0 wt %, and the balance being Ni and unavoidable impurities, and a method for producing the same are disclosed. The Ni-base superalloy has excellent creep property at high temperature and is suitable for use as a member at high temperature under high stress.

4 Claims, 2 Drawing Sheets

NI-BASE SUPERALLOY AND METHOD FOR PRODUCING THE SAME

TECHNICAL FIELD

The present invention relates to a Ni-base superalloy and a method for producing the same. More particularly, the present invention relates to a novel conventionally cast Ni-base alloy, directionally solidified Ni-base superalloy or Ni-base single crystal superalloy, having excellent creep property at high temperature, and suitable as a member used at high temperature and under high stress, such as turbine blades, turbine vanes or the like of jet engines, gas turbines or the like, and a method for producing the same.

BACKGROUND ART

Conventionally, a Ni-base superalloy is used as a material of rotor blades and stator vanes, which is a high temperature member such as aircraft engines or gas turbine engines. The Ni-base superalloy has γ (gamma) matrix which is an austenite phase and γ' (gamma prime) phase which is an ordered phase dispersed and precipitated in the matrix. The γ' phase mainly comprises an intermetallic compound represented by $Ni_3Al$, and due to the presence of this γ' phase, high temperature strength of a superalloy is improved.

Raising a combustion gas temperature is most effective to increase efficiency of gas turbine engine, and for this reason, a Ni-base superalloy having further excellent high temperature strength is desired. A conventionally cast Ni-base alloy, a directionally solidified Ni-base superalloy and a Ni-base single crystal superalloy are realized by the compositional ratio of an alloy and the improvement of production process. In recent years, a Ni-base single crystal superalloy and a directionally solidified Ni-base superalloy, having compositional ratio of Re (rhenium) exceeding 5 wt %, that are called a third generation superalloy are developed (Patent Document 1), but had the problem that when solid solution amount of Re into γ phase exceeds the limit, a so-called TCP phase (Topologically Close Packed phase) is precipitated at high temperature, resulting in deterioration of high temperature properties. Furthermore, development of a Ni-base single crystal superalloy and a directionally solidified Ni-base superalloy of fourth and fifth generations is carried out by adding a platinum group element such as Ru (Ruthenium), thereby suppressing formation of TCP phase and attempting to improve high temperature strength (Patent Document 2).

Patent Document 1: U.S. Pat. No. 4,643,782

Patent Document 2: U.S. Pat. No. 6,929,868

DISCLOSURE OF INVENTION

Problems that the Invention is to Solve

Increase in addition amount of a high melting point alloy element which is effective to improve strength of a Ni-base superalloy increases specific gravity of an alloy. When used in a rotor vane member, centrifugal force itself is increased, thereby decreasing creep life, and furthermore, load to a turbine disk is increased, resulting in decrease of disk life and the like. Thus, it makes difficult to apply to aircraft engines and gas turbine engines.

Therefore, the present invention has been made to solve the above problems, and has an object to provide a Ni-base superalloy having excellent high temperature strength and low specific gravity while preventing formation of TCP phase, and a method for producing the same.

Means for Solving the Problems

To solve the above problems, a first aspect of the present invention is to provide a Ni-base superalloy having a chemical composition comprising Al: 4.5-7.0 wt %, Ta+Nb+Ti: 0.1-4.0 wt %, with Ta being less than 4.0 wt %, Mo: 1.0-8.0 wt %, W: 0.0-10.0 wt %, Re: 2.0-8.0 wt %, Hf: 0.0-1.0 wt %, Cr: 2.0-10.0 wt %, Co: 0.0-15.0 wt %, Ru: 0.0-5.0 wt %, and the balance being Ni and unavoidable impurities.

A second aspect of the invention is to provide the Ni-base superalloy of the first aspect, wherein the chemical composition comprises Al: 4.5-7.0 wt %, Ta+Nb+Ti: 0.1-4.0 wt %, with Ta being less than 4.0 wt %, Mo: 1.5-7.5 wt %, W: 0.0-9.0 wt %, Re: 2.0-8.0 wt %, Hf: 0.0-1.0 wt %, Cr: 2.5-8.0 wt %, Co: 0.0-12.0 wt %, Ru: 0.0-4.6 wt %, and the balance being Ni and unavoidable impurities.

A third aspect of the invention is to provide the Ni-base superalloy of the first or second aspect, wherein the chemical composition comprises Al: 4.5-7.0 wt %, Ta+Nb+Ti: 0.1-4.0 wt %, with Ta being less than 4.0 wt %, Mo: 1.0-5.0 wt %, W: 4.0-7.0 wt %, Re: 3.5-8.0 wt %, Hf: 0.01-1.0 wt %, Cr: 2.0-4.5 wt %, Co: 4.0-8.0 wt %, Ru: 2.0-5.0 wt %, and the balance being Ni and unavoidable impurities.

A fourth aspect of the invention is to provide the Ni-base superalloy of the second aspect, wherein the chemical composition comprises Al: 4.7-6.5 wt %, Ta+Nb+Ti: 0.1-4.0 wt %, with Ta being less than 4.0 wt %, Mo: 1.8-4.0 wt %, W: 4.6-6.6 wt %, Re: 5.4-8.0 wt %, Hf: 0.01-1.0 wt %, Cr: 2.2-4.2 wt %, Co: 4.8-6.8 wt %, Ru: 2.6-4.6 wt %, and the balance being Ni and unavoidable impurities.

A fifth aspect of the invention is to provide the Ni-base superalloy of any one of the first to fourth aspects, wherein the chemical composition comprises Al: 5.7 wt %, Ta: 1.6 wt %, Nb: 2.0 wt %, Mo: 2.8 wt %, W: 5.6 wt %, Re: 6.9 wt %, Hf: 0.1 wt %, Cr: 3.2 wt %, Co: 5.8 wt %, Ru: 3.6 wt %, and the balance being Ni and unavoidable impurities.

A sixth aspect of the invention is to provide the Ni-base superalloy of any one of the first to fourth aspects, wherein the chemical composition comprises Al: 5.7 wt %, Ta: 1.6 wt %, Nb: 2.0 wt %, Mo: 3.0 wt %, W: 5.6 wt %, Re: 6.4 wt %, Hf: 0.1 wt %, Cr: 3.2 wt %, Co: 5.8 wt %, Ru: 3.6 wt %, and the balance being Ni and unavoidable impurities.

A seventh aspect of the invention is to provide the Ni-base superalloy of any one of the first to fourth aspects, wherein the chemical composition comprises Al: 5.7 wt %, Ta: 1.6 wt %, Nb: 1.5 wt %, Ti: 0.5 wt %, Mo: 2.8 wt %, W: 5.6 wt %, Re: 6.5 wt %, Hf: 0.1 wt %, Cr: 3.2 wt %, Co: 5.8 wt %, Ru: 3.6 wt %, and the balance being Ni and unavoidable impurities.

An eighth aspect of the invention is to provide the Ni-base superalloy of the first or second aspect, wherein the chemical composition comprises Al: 5.6 wt %, Nb: 2.3 wt %, Ti: 0.9 wt %, Mo: 6.7 wt %, Re: 3.0 wt %, Cr: 7.6 wt %, and the balance being Ni and unavoidable impurities.

A ninth aspect of the invention is to provide the Ni-base superalloy of the first or second aspect, wherein the chemical composition comprises Al: 5.6 wt %, Ta: 3.4 wt %, Ti: 0.5 wt %, Mo: 3.8 wt %, W: 8.5 wt %, Re: 2.4 wt %, Hf: 0.09 wt %, Cr: 4.7 wt %, Co: 7.5 wt %, and the balance being Ni and unavoidable impurities.

A tenth aspect of the invention is to provide the Ni-base superalloy of the first or second aspect, wherein the chemical composition comprises Al: 5.4 wt %, Ta: 3.5 wt %, Ti: 0.5 wt %, Mo: 3.9 wt %, W: 8.7 wt %, Re: 2.4 wt %, Hf: 0.1 wt %, Cr: 4.9 wt %, Co: 7.8 wt %, and the balance being Ni and unavoidable impurities.

An eleventh aspect of the invention is to provide the Ni-base superalloy of the first or second aspect, wherein the chemical composition comprises Al: 6.0 wt %, Nb: 3.2 wt %, Mo: 2.0 wt %, W: 6.0 wt %, Re: 5.0 wt %, Hf: 0.1 wt %, Cr: 3.0 wt %, Co: 12.0 wt %, and the balance being Ni and unavoidable impurities.

A twelfth aspect of the invention is to provide the Ni-base superalloy of any one of the first to eleventh aspects, wherein the chemical composition further comprises C: 0.05 wt % or less, Zr: 0.1 wt % or less, V: 0.5 wt % or less, B: 0.02 wt % or less, Si: 0.1 wt % or less, Y: 0.2 wt % or less, La: 0.2 wt % or less and Ce: 0.2 wt % or less alone or as mixtures thereof.

A thirteenth aspect of the invention is that the Ni-base superalloy of any one of the first to twelfth aspects is cast with a conventional casting method, a directional solidification method or a single crystal solidification method.

A fourteenth aspect of the invention is that after casting, a pre-heating treatment at 1,200 to 1,300° C. for 20 minutes to 2 hours is applied, and a solid solution treatment at 1,280 to 1,360° C. for 3 to 10 hours, a first aging treatment at 1,050 to 1,150-C for 2 to 8 hours, and a second aging treatment at 800 to 900° C. for 10 to 24 hours are then applied.

Effects Of Invention

A Ni-base superalloy has the tendency to increase its specific gravity with increased amount of Ru as a platinum group element. Therefore, the present invention realizes a Ni-base single crystal superalloy of high specific strength (strength per unit specific gravity) without sacrificing high temperature strength and with suppressed increase of specific gravity by that the Ta+Nb+Ti compositional ratio is in a range of 0.1 to 4.0 wt %, and Ta is less than 4 wt %. When such a Ni-base single crystal superalloy is used in turbine blades, turbine vanes, turbine disks or the like of jet engines, gas turbines or the like, it can be used in, for example, a combustion gas of higher temperature, and this is effective to improve efficiency of jet engines, gas turbines or the like, and to reduce fuels.

Furthermore, the invention realizes a conventionally cast Ni-base alloy and a directionally solidified Ni-base superalloy. High temperature strength is excellent similar to a Ni-base single crystal superalloy, casting properties are improved, and yield of products becomes better. The conventionally cast Ni-base alloy and directionally solidified Ni-base superalloy are useful in the same use application as the Ni-base single crystal superalloy.

BEST MODE FOR CARRYING OUT THE INVENTION

Figure 1:
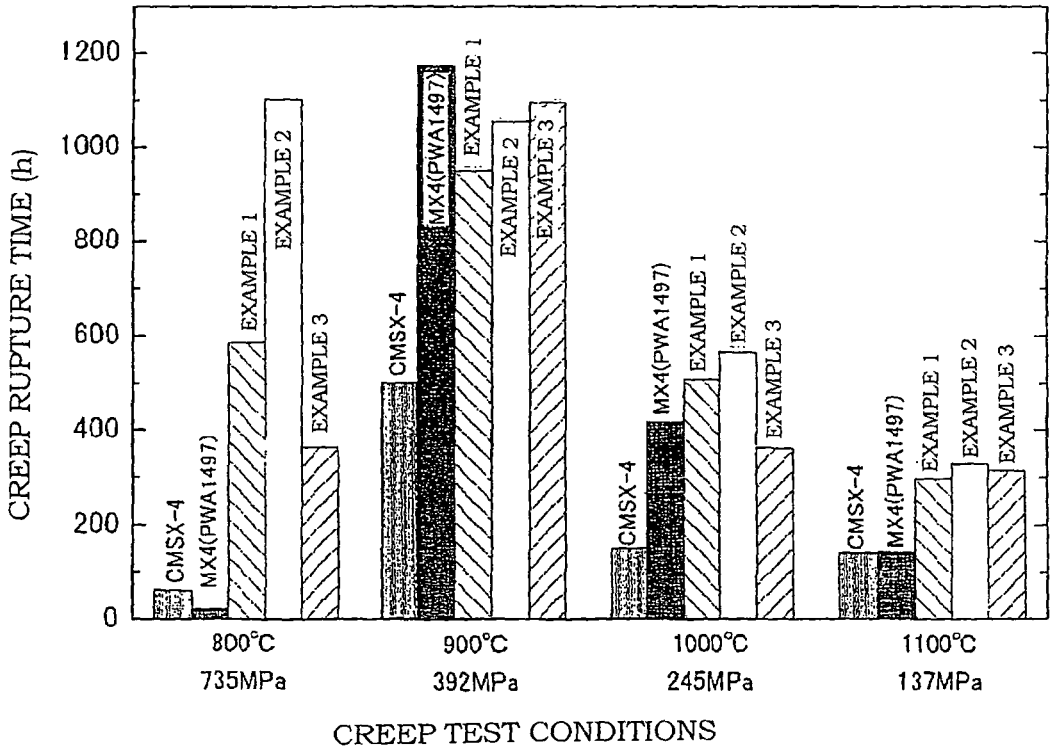
FIG. 1 is a view comparing creep life between the Ni-base single crystal superalloys of Examples 1 to 3 and the conventional Ni-base single crystal alloys in every test condition.

The Ni-based single crystal superalloy, directionally solidified Ni-base superalloy and conventionally cast Ni-base alloy provided by the present invention have γ (gamma) phase (matrix) which is an austenite phase and γ' (gamma prime) phase (precipitated phase) which is an ordered phase dispersed and precipitated in the matrix. The γ' phase mainly comprises an intermetallic compound represented by $Ni_3Al$, and due to the presence of this γ' phase, high temperature strength of a superalloy is further improved.

Based on the above acknowledgement, the Ni-base superalloy of the present invention defines the chemical composition as follows.

That is, in the Ni-base superalloy having the first aspect of the invention, Cr (chromium) is an element having excellent oxidation resistance, and improves high temperature corrosion resistance. The content of Cr is 2.0 to 10.0 wt %. Where Cr is less than 2.0 wt %, the desired high temperature corrosion resistance cannot be ensured, and where Cr exceeds 10.0 wt %, precipitate of γ' phase is suppressed, and additionally, a harmful phase such as σ (sigma) phase or μ (mu) phase is formed, resulting in deterioration of high temperature strength.

Mo (molybdenum) is solid solubilized in γ phase as the matrix in the co-presence of W (tungsten) and Ta (tantalum) to increase high temperature strength, and additionally contributes to high temperature strength by precipitation hardening. The content of Mo is 1.0 to 8.0 wt %. Where the content of Mo is less than 1.0 wt %, the desired high temperature strength cannot be ensured. Furthermore, where the content of Mo exceeds 8.0 wt %, high temperature strength is decreased, and high temperature corrosion resistance also deteriorates.

W (tungsten) improves high temperature strength by the action of solid solution strengthening and precipitation hardening in the co-presence of Mo and Ta. The content of W is 0.0 to 10.0 wt %. Where the content of W exceeds 10.0 wt %, formation of a harmful phase is assisted, and additionally high temperature corrosion resistance deteriorates.

Ta (tantalum), Nb (niobium) and Ti (titanium) each improve high temperature strength by the action of solid solution strengthening and precipitation hardening in the co-presence of Mo and W. Furthermore, a part of those is precipitation-hardened to γ' phase, thereby improving high temperature strength. The content of Ta+Nb+Ti is 0.1 to 4.0 wt % by the adjustment of the respective contents, and the content of Ta is less than 4.0 wt %. Where the content of Ta+Nb+Ti is less 0.1 wt %, it is difficult to improve high temperature strength, and where the content exceeds 4.0 wt %, it is difficult to maintain the specific gravity of the alloy at 9.0 g/cm$^3$ or less while ensuring the desired high temperature strength.

Al (aluminum) is united with Ni (nickel) to form an intermetallic compound represented by $Ni_3Al$ constituting γ' phase finely and uniformly dispersed and precipitated in the matrix in a proportion of 60 to 70% in volume fraction, thereby improving high temperature strength. The compositional ratio of Al is 4.5 to 7.0 wt %. Where the content of Al is less than 4.5 wt %, the amount of γ' phase precipitated is deficient, and the desired high temperature strength cannot be ensured. Where the content exceeds 7.0 wt %, coarse γ' phase called eutectic γ' phase is formed in large amount. This makes it impossible to conduct solution treatment, and high high-temperature strength cannot be ensured.

Hf (hafnium) is a grain boundary segregation element, and strengthens a grain boundary by segregating the grain boundary between γ phase and γ' phase, thereby particularly improving high temperature strength of the conventionally cast Ni-base alloy and the directionally solidified Ni-base superalloy. The content of Hf is 0.0 to 1.0 wt %. In the case of the Ni-base single crystal superalloy, Hf is added in a slight amount or may not be contained. However, in the case of the conventionally cast Ni-base alloy and the directionally solidified Ni-base superalloy, if Hf is not contained, crystal grain boundary strengthening is deficient, and the desired high temperature strength cannot be ensured. Where the content of Hf exceeds 1.0 wt %, local fusion is induced, and there is the possibility to decrease high temperature strength.

Co (cobalt) increases solubility limit at high temperature to a matrix such as Al or Ta, dispersion precipitates fine γ' phase by heat treatment, and improves high temperature strength. The content of Co is 0.0 to 15.0 wt %. Where the solubility limit that does not precipitates a harmful phase is sufficiently wide, it is possible to ensure high temperature strength even though Co is not contained. Where the content exceeds 15.0 wt %, the balance to other element such as Al, Ta, Mo, W, Hf or Cr is disrupted, and a harmful phase is precipitated, thereby deteriorating high temperature strength.

Re (rhenium) is solid solubilized in γ phase as the matrix at high content and improves high temperature strength by solid solution strengthening. Furthermore, Re has the effect to improve corrosion resistance. On the other hand, where Re is added in large amount, TCP phase which is a harmful phase is precipitated at high temperature, and there is the possibility that high temperature strength deteriorates. The content of Re is 2.0 to 8.0 wt %. Where the content is less than 2.0 wt %, solid solution strengthening of γ phase is deficient, and the desired high temperature strength cannot be ensured. Where the content exceeds 8.0 wt %, TCP phase is precipitated at high temperature, and high high-temperature strength cannot be ensured.

Ru (Ruthenium) suppresses precipitation of TCP phase, thereby improving high temperature strength. The content of Ru is 0.0 to 5.0 wt %. The content of Ru has the optimum compositional range to the content of a main element constituting TCP phase, such as Re, W, Mo or Cr. Where TCP phase is not precipitated, Ru may not be added. Ru is an expensive metal, and where the content thereof exceeds 5.0 wt %, cost is increased.

The Ni-base superalloys having the second to eleventh aspects define the preferable compositional ranges.

That is, the Ni-base superalloy having the second aspect is defined as Al: 4.5-7.0 wt %, Ta+Nb+Ti: 0.1-4.0 wt %, with Ta being less than 4.0 wt %, Mo: 1.5-7.5 wt %, W: 0.0-9.0 wt %, Re: 2.0-8.0 wt %, Hf: 0.0-1.0 wt %, Cr: 2.5-8.0 wt %, Co: 0.0-12.0 wt %, and Ru: 0.0-4.6 wt %.

The Ni-base superalloy having the third aspect is defined as Al: 4.5-7.0 wt %, Ta+Nb+Ti: 0.1-4.0 wt %, with Ta being less than 4.0 wt %, Mo: 1.0-5.0 wt %, W: 4.0-7.0 wt %, Re: 3.5-8.0 wt %, Hf: 0.01-1.0 wt %, Cr: 2.0-4.5 wt %, Co: 4.0-8.0 wt %, and Ru: 2.0-5.0 wt %.

The Ni-base superalloy having the fourth aspect is defined as Al: 4.7-6.5 wt %, Ta+Nb+Ti: 0.1-4.0 wt %, with Ta being less than 4.0 wt %, Mo: 1.8-4.0 wt %, W: 4.6-6.6 wt %, Re: 5.4-8.0 wt %, Hf: 0.01-1.0 wt %, Cr: 2.2-4.2 wt %, Co: 4.8-6.8 wt %, and Ru: 2.6-4.6 wt %.

The Ni-base superalloy having the fifth aspect is defined as Al: 5.7 wt %, Ta: 1.6 wt %, Nb: 2.0 wt %, Mo: 2.8 wt %, W: 5.6 wt %, Re: 6.9 wt %, Hf: 0.1 wt %, Cr: 3.2 wt %, Co: 5.8 wt %, and Ru: 3.6 wt %.

The Ni-base superalloy having the sixth aspect is defined as Al: 5.7 wt %, Ta: 1.6 wt %, Nb: 2.0 wt %, Mo: 3.0 wt %, W: 5.6 wt %, Re: 6.4 wt %, Hf: 0.1 wt %, Cr: 3.2 wt %, Co: 5.8 wt %, and Ru: 3.6 wt %.

The Ni-base superalloy having the seventh aspect is defined as Al: 5.7 wt %, Ta: 1.6 wt %, Nb: 1.5 wt %, Ti: 0.5 wt %, Mo: 2.8 wt %, W: 5.6 wt %, Re: 6.5 wt %, Hf: 0.1 wt %, Cr: 3.2 wt %, Co: 5.8 wt %, and Ru: 3.6 wt %.

The Ni-base superalloy having the eighth aspect is defined as Al: 5.6 wt %, Nb: 2.3 wt %, Ti: 0.9 wt %, Mo: 6.7 wt %, Re: 3.0 wt %, and Cr: 7.6 wt %.

The Ni-base superalloy having the ninth aspect is defined as Al: 5.6 wt %, Ta: 3.4 wt %, Ti: 0.5 wt %, Mo: 3.8 wt %, W: 8.5 wt %, Re: 2.4 wt %, Hf: 0.09 wt %, Cr: 4.7 wt %, and Co: 7.5 wt %.

The Ni-base superalloy having the tenth aspect is defined as Al: 5.4 wt %, Ta: 3.5 wt %, Ti: 0.5 wt %, Mo: 3.9 wt %, W: 8.7 wt %, Re: 2.4 wt %, Hf: 0.1 wt %, Cr: 4.9 wt %, and Co: 7.8 wt %.

The Ni-base superalloy having the eleventh aspect is defined as Al: 6.0 wt %, Nb: 3.2 wt %, Mo: 2.0 wt %, W: 6.0 wt %, Re: 5.0 wt %, Hf: 0.1 wt %, Cr: 3.0 wt %, and Co: 12.0 wt %.

In the Ni-base superalloy of the invention having any one of the first to eleventh aspects, the balance comprises Ni and unavoidable impurities. The Ni-base superalloy of the invention having any one of the first to eleventh aspects can further contain the following elements in specific ranges alone or in combination thereof.

C (carbon) contributes to brain boundary strengthening, and the content of C is 0.05 wt % or less. Where C is not contained, the effect of grain boundary strengthening cannot be ensured, which is not preferred. Where the content of C exceeds 0.05 wt %, ductility is impaired, which is not preferred.

Zr (zirconium) strengthens the grain boundary similar to B (boron) and C. On the other hand, excessive addition decreases creep strength. Therefore, the content is 0.1 wt % or less.

V (vanadium) is solid solubilized in γ' phase to strengthen γ' phase. On the other hand, excessive addition decreases creep strength. Therefore, the content is 0.5 wt % or less.

B (boron) contributes to grain boundary strengthening similar to C. The content of B is 0.02 wt % or less. Where the content exceeds 0.02 wt %, ductility is impaired, which is not preferred.

Si (silicon) forms $SiO_2$ coating film on the surface of an alloy, and the coating film acts as a protective coating film to improve oxidation resistance. Furthermore, the $SiO_2$ oxide coating film is difficult to generate cracks as compared with other protective oxide coating films, and has the effect to improve creep and fatigue properties. On the other hand, the addition of Si in large amount results in decrease of solubility limit of other elements. Therefore, the upper limit of the content is 0.1 wt %.

Y (yttrium), La (lanthanum) and Ce (cerium) improve adhesion of a protective oxide coating film such as alumina or chromia formed during use in a Ni-base superalloy at high temperature. On the other hand, the excessive addition results in decrease of the solubility limit of other elements. Therefore, the content of Y is 0.2 wt % or less, the content of La is 0.2 wt % or less, and the content of Ce is 0.2 wt % or less.

The Ni-base superalloy of the invention having the chemical composition as above can be produced by melting and casting as one having a given chemical composition, taking into consideration the conventional production process and production conditions. In casting, a Ni-base superalloy can be produced as a directionally solidified alloy or a single crystal alloy by a directional solidification method or a single crystal solidification method. The directional solidification method conducts casting using an ingot prepared in the desired chemical composition, and is a method that the casting mold is heated to a temperature of about 1,500° C. or higher which is a solidification temperature, the ingot is charged in the casting mold, the casting mold is then gradually moved away from a heating furnace to give temperature gradient, for example, and many crystals are directionally grown. The single crystal solidification method is substantially the same as the directional solidification method, and is a method that a zigzag or spiral selector part is provided before solidification, many crystals directionally solidified are formed into a single crystal in a selector part, thereby producing the desired product.

The Ni-base superalloy of the invention develops high creep strength by applying heat treatment after casting. The standard heat treatment is as follows. After applying a pre-heat treatment at 1,200 to 1,300° C. for 20 minutes to 2 hours, solution treatment is conducted at 1,280 to 1,350° C. for 3 to 10 hours. Subsequently, a first aging treatment for the purpose of precipitation of γ' phase is conducted in a temperature range of 1,050 to 1,150° C. for 2 to 8 hours, and air cooling is conducted. The first aging treatment can combine with a coating treatment for the purpose of heat resistance and oxidation resistance. After air cooling, a second aging treatment for the purpose of stabilization of γ' phase is subsequently conducted at 800 to 900° C. for 10 to 24 hours, and air cooling is conducted. The air cooling in the first aging treatment and the second aging treatment can be conducted by replacing the atmosphere with an inert gas.

The Ni-base superalloy of the invention thus produced makes it possible to realize high temperature components such as turbine blades, turbine vanes or the like of jet engines or gas turbines.

The Examples are described below. The invention is not limited by the following Examples.

Example 1

A Ni-base superalloy having a chemical composition comprising Co: 5.8 wt %, Cr: 3.2 wt %, Mo: 2.8 wt %, W: 5.6 wt %, Al: 5.7 wt %, Nb: 2.0 wt %, Ta: 1.6 wt %, Hf: 0.1 wt %, Re: 6.9 wt %, Ru: 3.6 wt %, and the balance being Ni and unavoidable impurities was melted and cast at a solidification rate of 200 mm/h in vacuum to obtain a single crystal casting. Subsequently, the single crystal casting obtained was pre-heated at a temperature of 1,300° C. for 1 hour in vacuum, and the temperature was elevated to 1,330° C. Solution treatment of maintaining at this temperature for 10 hours and then air cooling was conducted. Subsequently, a first aging treatment of maintaining at a temperature of 1,100° C. for 4 hours in vacuum and then air cooling and a second aging treatment of maintaining at a temperature of 870° C. for 20 hours in vacuum and then air cooling were conducted. The single crystal alloy casting was processed into a test piece having a diameter of a parallel portion of 4 mm and a length of 20 mm, and a creep test was conducted under the conditions of 800 to 1,100° C. and 137 to 735 MPa.

Example 2

A Ni-base superalloy having a chemical composition comprising Co: 5.8 wt %, Cr: 3.2 wt %, Mo: 3.0 wt %, W: 5.6 wt %, Al: 5.7 wt %, Nb: 2.0 wt %, Ta: 1.6 wt %, Hf: 0.1 wt %, Re: 6.4 wt %, Ru: 3.6 wt %, and the balance being Ni and unavoidable impurities was melted and cast at a solidification rate of 200 mm/h in vacuum to obtain a single crystal casting. The single crystal casting obtained was pre-heated at a temperature of 1,300° C. for 1 hour in vacuum, and the temperature was elevated to 1,330° C. Solution treatment of maintaining at this temperature for 10 hours and then air cooling was conducted. Subsequently, a first aging treatment of maintaining at a temperature of 1,100° C. for 4 hours in vacuum and then air cooling and a second aging treatment of maintaining at a temperature of 870° C. for 20 hours in vacuum and then air cooling were conducted. The single crystal alloy casting was processed into a test piece having a diameter of a parallel portion of 4 mm and a length of 20 mm, and a creep test was conducted under the conditions of 800 to 1,100° C. and 137 to 735 MPa.

Example 3

A Ni-base superalloy having a chemical composition comprising Co: 5.8 wt %, Cr: 3.2 wt %, Mo: 2.8 wt %, W: 5.6 wt %, Al: 5.7 wt %, Ti: 0.5 wt %, Nb: 1.5 wt %, Ta: 1.6 wt %, Hf: 0.1 wt %, Re: 6.5 wt %, Ru: 3.6 wt %, and the balance being Ni and unavoidable impurities was melted and cast at a solidification rate of 200 mm/h in vacuum to obtain a single crystal casting. Subsequently, the single crystal casting obtained was pre-heated at a temperature of 1,300° C. for 1 hour in vacuum, and the temperature was elevated to 1,330° C. Solution treatment of maintaining at this temperature for 10 hours and then air cooling was conducted. Subsequently, a first aging treatment of maintaining at a temperature of 1,100° C. for 4 hours in vacuum and then air cooling and a second aging treatment of maintaining at a temperature of 870° C. for 20 hours in vacuum and then air cooling were conducted. The single crystal alloy casting was processed into a test piece having a diameter of a parallel portion of 4 mm and a length of 20 mm, and a creep test was conducted under the conditions of 800 to 1,100° C. and 137 to 735 MPa.

Example 4

A Ni-base superalloy having a chemical composition comprising Cr: 7.6 wt %, Mo: 6.7 wt %, Al: 5.6 wt %, Ti: 0.9 wt %, Nb: 2.3 wt %, Re: 3.0 wt %, and the balance being Ni and unavoidable impurities was melted and cast at a solidification rate of 200 mm/h in vacuum to obtain a single crystal casting. Subsequently, the single crystal casting obtained was pre-heated at a temperature of 1,260° C. for 1 hour in vacuum, and the temperature was elevated to 1,280° C. Solution treatment of maintaining at this temperature for 4 hours and then air cooling was conducted. Subsequently, a first aging treatment of maintaining at a temperature of 982° C. for 5 hours in vacuum and then air cooling and a second aging treatment of maintaining at a temperature of 870° C. for 20 hours in vacuum and then air cooling were conducted. The single crystal alloy casting was processed into a test piece having a diameter of a parallel portion of 4 mm and a length of 20 mm, and a creep test was conducted under the conditions of 900 to 1,100° C. and 137 to 392 MPa.

Example 5

A Ni-base superalloy having a chemical composition comprising Co: 7.5 wt %, Cr: 4.7 wt %, Mo: 3.8 wt %, W: 8.5 wt %, Al: 5.6 wt %, Ti: 0.5 wt %, Ta: 3.4 wt %, Hf: 0.09 wt %, Re: 2.4 wt %, and the balance being Ni and unavoidable impurities was melted and cast at a solidification rate of 200 mm/h in vacuum to obtain a single crystal casting. Subsequently, the single crystal casting obtained was pre-heated at a temperature of 1,300° C. for 1 hour in vacuum, and the temperature was elevated to 1,320° C. Solution treatment of maintaining at this temperature for 5 hours and then air cooling was conducted. Subsequently, a first aging treatment of maintaining at a temperature of 1,100° C. for 4 hours in vacuum and then air cooling and a second aging treatment of maintaining at a temperature of 870° C. for 20 hours in vacuum and then air cooling were conducted. The single crystal alloy casting was processed into a test piece having a diameter of a parallel portion of 4 mm and a length of 20 mm, and a creep test was conducted under the conditions of 900 to 1,100° C. and 137 to 392 MPa.

Example 6

A Ni-base superalloy having a chemical composition comprising Co: 7.8 wt %, Cr: 4.9 wt %, Mo: 3.9 wt %, W: 8.7 wt %, Al: 5.4 wt %, Ti: 0.5 wt %, Ta: 3.5 wt %, Hf: 0.1 wt %, Re: 2.4 wt %, and the balance being Ni and unavoidable impurities was melted and cast at a solidification rate of 200 mm/h in vacuum to obtain a single crystal casting. Subsequently, the single crystal casting obtained was pre-heated at a temperature of 1,320° C. for 1 hour in vacuum, and the temperature was elevated to 1,340° C. Solution treatment of maintaining at this temperature for 5 hours and then air cooling was conducted. Subsequently, a first aging treatment of maintaining at a temperature of 1,100° C. for 4 hours in vacuum and then air cooling and a second aging treatment of maintaining at a temperature of 870° C. for 20 hours in vacuum and then air cooling were conducted. The single crystal alloy casting was processed into a test piece having a diameter of a parallel portion of 4 mm and a length of 20 mm, and a creep test was conducted under the conditions of 900 to 1,100° C. and 137 to 392 MPa.

Example 7

A Ni-base superalloy having a chemical composition comprising Co: 12.0 wt %, Cr: 3.0 wt %, Mo: 2.0 wt %, W: 6.0 wt %, Al: 6.0 wt %, Nb: 3.2 wt %, Hf: 0.1 wt %, Re: 5.0 wt %, and the balance being Ni and unavoidable impurities was melted and cast at a solidification rate of 200 mm/h in vacuum to obtain a single crystal casting. Subsequently, the single crystal casting obtained was pre-heated at a temperature of 1,300° C. for 1 hour in vacuum, and the temperature was elevated to 1,320° C. Solution treatment of maintaining at this temperature for 5 hours and then air cooling was conducted. Subsequently, a first aging treatment of maintaining at a temperature of 1,100° C. for 4 hours in vacuum and then air cooling and a second aging treatment of maintaining at a temperature of 870° C. for 20 hours in vacuum and then air cooling were conducted. The single crystal alloy casting was processed into a test piece having a diameter of a parallel portion of 4 mm and a length of 20 mm, and a creep test was conducted under the conditions of 900 to 1,100° C. and 137 to 392 MPa.

Chemical compositions of the Ni-base single crystal superalloys produced in Examples 1 to 7 above and the conventional Ni-base single crystal superalloys are shown in Table 1.

TABLE 1

| Alloy | Nominal composition (wt %, balance being Ni) | | | | | | | | | | |
|---|---|---|---|---|---|---|---|---|---|---|---|
| | Co | Cr | Mo | W | Al | Ti | Nb | Ta | Hf | Re | Ru |
| Example 1 | 5.8 | 3.2 | 2.8 | 5.6 | 5.7 | — | 2.0 | 1.6 | 0.1 | 6.9 | 3.6 |
| Example 2 | 5.8 | 3.2 | 3.0 | 5.6 | 5.7 | — | 2.0 | 1.6 | 0.1 | 6.4 | 3.6 |
| Example 3 | 5.8 | 3.2 | 2.8 | 5.6 | 5.7 | 0.5 | 1.5 | 1.6 | 0.1 | 6.5 | 3.6 |
| Example 4 | — | 7.6 | 6.7 | — | 5.6 | 0.9 | 2.3 | — | — | 3.0 | — |
| Example 5 | 7.5 | 4.7 | 3.8 | 8.5 | 5.6 | 0.5 | — | 3.4 | 0.09 | 2.4 | — |
| Example 6 | 7.8 | 4.9 | 3.9 | 8.7 | 5.4 | 0.5 | — | 3.5 | 0.1 | 2.4 | — |
| Example 7 | 12.0 | 3.0 | 2.0 | 6.0 | 6.0 | — | 3.2 | — | 0.1 | 5.0 | — |
| CMSX-4 | 9.6 | 6.4 | 0.6 | 6.4 | 5.6 | 1.0 | — | 6.5 | 0.1 | 3.0 | — |
| MX4 PWA1497 | 16.5 | 2.0 | 2.0 | 6.0 | 5.55 | — | — | 8.25 | 0.15 | 5.95 | 3.0 |

CMSX-4 alloy as the comparative alloy is the conventional ally which is most widely used, and is disclosed in, for example, U.S. Pat. No. 4,643,782. Furthermore, MX4 (PWA1497) alloy is a fourth generation alloy containing 3 wt % of Ru (ruthenium) disclosed in U.S. Pat. No. 6,929,868.

Creep rupture life, elongation and drawing of the Ni-base single crystal superalloys of Examples 1 to 3 and the conventional Ni-base single crystal superalloys were the results shown in Table 2.

TABLE 2

| Alloy | Specific gravity (g/cm$^3$) | Creep rupture life (hr) | | | |
|---|---|---|---|---|---|
| | | 800° C. 735 MPa | 900° C. 392 MPa | 1,000° C. 245 MPa | 1,100° C. 137 MPa |
| Example 1 | 8.89 | 583 | 948 | 506 | 295 |
| Example 2 | 8.87 | 1,101 | 1,055 | 564 | 327 |
| Example 3 | 8.84 | 363 | 1,093 | 361 | 313 |
| Example 4 | 8.27 | — | 119 | 70 | 40 |
| Example 5 | 8.61 | — | 294 | 115 | 83 |
| Example 6 | 8.66 | — | 438 | 174 | 99 |
| Example 7 | 8.65 | — | 380 | 146 | 70 |
| CMSX-4 | 8.7 | 60* | 500 | 149 | 139 |
| MX4 PWA1497 | 9.2 | 22 | 1,172 | 416 | 142 |

*Estimate value using Larson-Miller parameter

The Ni-base single crystal superalloys of Examples 1 to 3 have specific gravity smaller than 9.0, and have excellent creep rupture life.

Furthermore, the creep rupture life in every creep test condition of the Ni-base single crystal superalloys of Examples 1 to 3 and the conventional Ni-base single crystal superalloys was the result shown in FIG. 1

Figure 2:
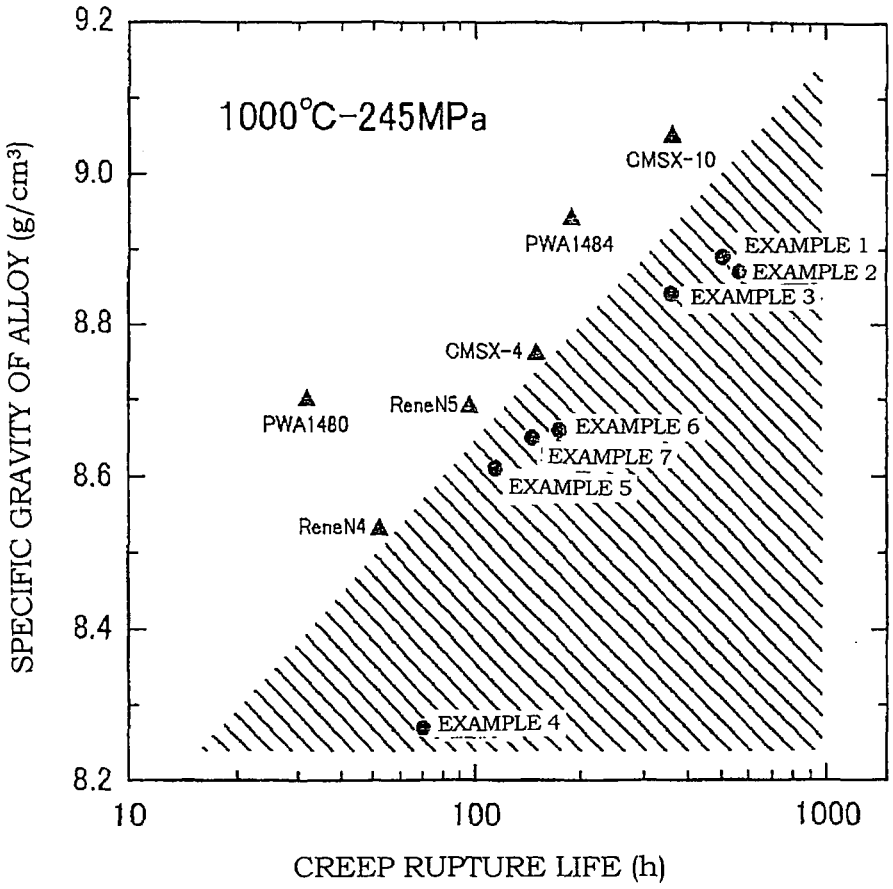
FIG. 2 is a view comparing creep life and specific gravity between the Ni-base single crystal superalloys of Examples 1 to 7 and the conventional Ni-base single crystal alloys.

Furthermore, the creep test results (1,000° C., 245 MPa) of the Ni-base single crystal superalloys of Examples 1 to 7 and the conventional Ni-base single crystal superalloys, and the respective specific gravity are compared and are shown in FIG. 2. As shown in FIG. 2, the Ni-base single crystal superalloys of Examples 1 to 7 have low specific gravity and prolonged creep life.

Industrial Applicability

A Ni-base single crystal superalloy having suppressed gravity increase and high specific strength (strength per unit gravity) without sacrificing high temperature strength is realized. When used in turbine blades, turbine vanes, turbine disks or the like of jet engines, gas turbines or the like, it is possible to use in, for example, a combustion gas of higher temperature, and this is effective to improve efficiency of jet engines and gas turbines, and to reduce fuel.

Furthermore, a conventionally cast Ni-base alloy and a directionally solidified Ni-base superalloy are realized, and have excellent high temperature strength similar to a Ni-base single crystal superalloy. Additionally, casting properties are improved, and yield of products becomes better. The conventionally cast Ni-base alloy and directionally solidified Ni-base superalloy are useful in the same use application as a Ni-base single crystal superalloy.

The invention claimed is:

1. A Ni-base superalloy having a chemical composition comprising:

Al: 4.7-7.0 wt %,
Ta+Nb+Ti: 1.5-3.6 wt %, with Ta being 1.6 wt % or less,
Nb: 1.5-3.2 wt %,
Mo: 1.0-8.0 wt %,
W: 0.0-10.0 wt %,
Re: 2.0-8.0 wt %,
Hf: 0.0-1.0 wt %,
Cr: 3.2 wt %,
Co: 0.0-15.0 wt %,
Ru: 3.6 wt %, and
the balance being Ni and unavoidable impurities.

2. A method of producing a Ni-base superalloy, which comprises casting the Ni-base superalloy as claimed in claim 1 with a conventional casting method, a directional solidification method or a single crystal solidification method.

3. The method for producing a Ni-base superalloy as claimed in claim 2, wherein after casting, a pre-heating treatment at 1,200 to 1,300° C. for 20 minutes to 2 hours is applied, and a solid solution treatment at 1,280 to 1,360° C. for 3 to 10 hours, a first aging treatment at 1,050 to 1,150° C. for 2 to 8 hours, and a second aging treatment at 800 to 900° C. for 10 to 24 hours are then applied.

4. A Ni-base superalloy having a chemical composition comprising:

Al: 5.7 wt %
Ta: 1.6 wt %
Nb: 1.5-2.0 wt %
Mo: 2.8-3.0 wt %
W: 5.6 wt %
Re: 6.4-6.9 wt %
Hf: 0.1 wt %
Cr: 3.2 wt %
Co: 5.8 wt %
Ru: 3.6 wt %, and
the balance being Ni and unavoidable impurities,
wherein the Ni-base superalloy has a creep rupture life from 295 to 313 hr, at 1100° C. and 137MPa.

* * * * *

UNITED STATES PATENT AND TRADEMARK OFFICE

CERTIFICATE OF CORRECTION

PATENT NO. : 8,696,979 B2
APPLICATION NO. : 12/225710
DATED : April 15, 2014
INVENTOR(S) : Yokokawa et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1257 days.

Signed and Sealed this
Twenty-ninth Day of September, 2015

Michelle K. Lee

Michelle K. Lee
*Director of the United States Patent and Trademark Office*